United States Patent [19]

Silverman et al.

[11] 4,213,284

[45] Jul. 22, 1980

[54] AUTOMATIC BAGGING APPARATUS

[75] Inventors: John H. Silverman, Nesconset, N.Y.; James P. Cahill, River Vale, N.J.

[73] Assignee: Precise Metal Parts Company, Emerson, N.Y.

[21] Appl. No.: 6,281

[22] Filed: Jan. 24, 1979

[51] Int. Cl.[2] ..... B65B 57/12; B65B 43/46

[52] U.S. Cl. ..... 53/74; 53/256

[58] Field of Search ..... 53/74, 241, 256

[56] References Cited

U.S. PATENT DOCUMENTS

| | | | |
|---|---|---|---|
| 3,287,881 | 11/1966 | Jelling et al. | 53/256 |
| 3,308,601 | 3/1967 | Masters | 53/256 |
| 3,895,480 | 7/1975 | Lombardo | 53/256 |
| 3,982,377 | 9/1976 | Vanderpool | 53/241 X |

*Primary Examiner*—Travis S. McGehee

*Attorney, Agent, or Firm*—Hubbell, Cohen, Stiefel & Gross

[57] ABSTRACT

Apparatus for forming bags about hanger mounted garments using heat sealable wrapping material from a continuous flattened tubular web supplied on a roll. When a hanger mounted garment is placed on the apparatus, a sufficient length of tubing is drawn over the garment, cut free, and sealed at one or both ends. When the wrapped garment is removed, the apparatus returns to starting position.

13 Claims, 19 Drawing Figures

| | | |
|---|---|---|
| FIG. 16A. | FIG. 16B. | FIG. 16C. |

AUTOMATIC BAGGING APPARATUS

BACKGROUND OF THE INVENTION

1. Field of the Invention

The present invention relates to apparatus for wrapping hanger mounted garments in bags, closed on the sides and across the top excepting for an opening to pass the hook of the hanger.

2. Description of the Prior Art

Apparatus for bagging garments is well known in the art. Clear polyethylene is usually employed as the wrapping material. It is inexpensive and readily available, protects well, is easily cut by melting using a heated edge, and may be sealed to itself by controlled pressure and heat.

Small users can obtain rolls of flattened polyethylene tubing pre-formed into bags which may be torn free one at a time and placed by hand over a hanger mounted garment. Manual fixtures are available to assist in the bagging. One is disclosed in Jelling, U.S. Pat. No. 3,287,881, and another in Masters, U.S. Pat. No. 3,308,601.

High volume establishments wrap from rolls of flattened polyethylene tubular web, supplied in continuous form without tear or seal lines, and do the forming of heat seal lines and the cutting to length as part of an automatic or semi-automatic bagging operation. One apparatus to do this is disclosed in Vanderpool, U.S. Pat. No. 3,982,377. Another is disclosed in Lombardo, U.S. Pat. No. 3,895,480. A third machine has been offered for sale by Better Methods, Inc. of Secaucus, New Jersey. The Better Methods apparatus is quite similar to the bagger disclosed in Lombardo. Better Methods is the closest known prior art to the present invention.

To use the Better Methods bagger, an operator first places a hanger mounted garment on the machine and then steps on a foot switch, which starts the machine. The machine automatically forms a bag in place on the garment, which the operator takes away. To reset the machine, the operator again steps on the foot switch, which causes the machine to return to starting position.

A roll of polyethylene tubing is supported in a holder which is controlled by use of an adjustable friction drag device. In this way, the roll is prevented from continuing to spin after completion of pulling a length of tubing. The amount of frictional drag necessary to avoid over-spin reduces continually as the roll mass diminishes, so frequent adjustments are necessary, particularly towards the end of a roll. The Better Methods machine applies this frictional drag at all times, including during pulling of tubing, so if the drag is adjusted too high, tubing may be torn or stretched. Too little friction results in overspin. The frequent adjustments are inconvenient.

Better Methods supports the roll horizontally and near the floor. The tubing is passed from the roll up and over a free-spinning horizontal roller, forward to and over another free-spinning horizontal roller, and down between two rubber-covered motor-driven rollers, fore and aft and parallel in a horizontal plane. Within the tubing at this point a four-roller cradle straddles the two driven rollers, one cradle roller just above and one just below the horizontal plane pressing against each driven roller through the tubing wall. When the driven rollers are operated, tubing is drawn from the supply roll.

A support hook depends centrally from the cradle to receive the hook of a hanger on which is mounted a garment to be bagged. Depending from the cradle fore and aft are two hinged "barn door" spreaders that are biased to swing open, which serve to keep the tubing open so that it can be pulled over such a garment.

One problem with this cradle design is that each time the machine is set up with a new roll of tubing, the supporting driven rollers must be removed, or at least spread apart, so that the four-roller cradle can be disposed straddling the supporting driven rollers and within the tubing.

Secondly, friction of the rubber-covered driven rollers against the polyethylene tubing may create static charge on the surface of the tubing which causes it to cling and so to be hard to handle. Since these rollers are driven, and necessarily so, the rubber covering is needed to prevent uncontrolled slippage. No simple solution is available such as electrically grounding the metal-surfaced cradle rollers, because of their inaccessability within the tubing.

The Better Methods machine has a carriage moveable downwards from a position just below the motor-driven support rollers and back up in return. It carries grips to engage the left and right sides of the tubing hanging from the crandle and held open by the spreaders. When tubing is to be drawn over a garment hung on the support hook, the grips sieze the tubing, the driven rollers and the carriage are both operated, each advancing tubing at the same rate as the other until enough tubing has been drawn, and then both stop.

The Better Methods bagger uses conventional electric motors, gearboxes and clutches to drive the carriage and the support rollers. Each time a motor is engaged, for example to pull a new length of tubing, there is a sharp impulse which jolts the mechanical components and may stretch or tear the polyethylene tubing.

To cut a tube length free after it has been drawn over a garment, and to form a heat seal line across the top above the garment, Better Methods provides separate cutting and sealing clamps above the garment position but below the cradle and its spreaders, with the cutting clamp uppermost. These clamps carry metal ribbons placed where each cut or seal is desired, and the ribbons may be heated electrically. The cutting ribbon remains hot all the time, but the seal ribbons are only heated briefly when a seal is to be formed. In operation, the seal clamp closes first, which serves to hold the tubing in place. Then the cutting clamp with its hot ribbon closes to sever the length of tube free just above the sealing clamp. A controlled electric current pulse then is supplied to each seal ribbon just sufficient to effect the seals. Then the clamps open.

Since the hook of the garment hanger extends through and beyond the seal of the completed bag, these clamps are in the vicinity of the support which receives that hook. The clamps are arranged to open widely, but the fact that the cutting ribbon is always hot presents a burn danger to an operator reaching up to place a hanger mounted garment on the support.

SUMMARY OF THE INVENTION

The garment bagging apparatus of the present application is made active by an operator stepping on a foot switch. If, while the foot switch is so depressed, the machine senses the presence of a hanger mounted garment in position for bagging, it proceeds to form a bag in place on the garment. When the machine senses that the completed bagged garment has been taken away, it resets to starting position.

The garment bagging apparatus is driven by a motor and control circuitry which begins movement at a constant predetermined acceleration until a predetermined velocity is reached, then operates at constant velocity, and when it is time to stop, decelerates at another constant predetermined rate until motion ceases. Thus, the jolts and sharp impulses often experienced with conventional motor drives are avoided, reducing wear and tear on the machinery and avoiding tearing or stretching of the tubing being pulled from a supply roll over a garment.

Further advantage is taken of this drive by the use of inertia principles in the tube pulling operation. The free end of the tubing is siezed and pulled forward at a constant predetermined acceleration using driving power from a motor and control as just mentioned. No driving power is applied at any other location to advance the tubing. All tube handling between the tube end and the supply roll is free wheeling with minimum friction, as is the holder of the supply roll. The inertia of the supply roll is augmented by attaching a flywheel of predetermined magnitude. In this way, controlled acceleration of the end of the tube is passed back along the tube to the supply roll where the augmented inertia requires a force from the tube in order that the supply roll may go along with the tubing acceleration. This inertial pulling force, substantially, is the pulling force carried by the tube. This force can be analyzed by looking separately at a first portion which accelerates the attached flywheel, and a second portion which accelerates the supply roll of polyethylene tubing.

As the tubing is used up the supply roll diminishes both in radius and in inertia. The decrease of the radius at which the acceleration and force of the tubing join the supply roll causes an increase in that first portion of the inertial pulling force which arises from the attached flywheel of fixed predetermined inertia. Concurrently, there is a decrease in the second portion of the inertial pulling force arising from the supply roll inertia, because, although the same radius effect just mentioned applies to it also, the supply roll inertia is decreasing even faster so as to give by combined effect a decrease in the second portion. Thus, the increase of the first portion offsets the decrease of the second portion, to a degree depending on the relative magnitude of the flywheel inertia.

The magnitude of the flywheel inertia is selected so that these changes are more or less equal. Then the total inertial pulling force during the acceleration phase of each tube pulling will remain substantially constant, from a time when the roll is relatively large, until it has all been used up. In any single pull, of one tube length, the tube force is large only during the acceleration phase, and drops off thereafter, so it is only necessary to consider the acceleration phase.

The other variable affecting the total tube pulling force is the rate of acceleration. This rate is built into the motor-control circuitry mentioned above, at a predetermined value which combined with the inertia values results in forces which will not stretch or tear tubing, and no adjustments are necessary as the supply roll diminishes or is replaced.

To prevent overspin of the supply roll at the time of completion of pulling the tubing, a brake is provided in the supply roll holder which is inoperative during pulling, but is applied to restrain rotation upon the completion of pulling. Similarly, pull-back of tubing after a bag length has been cut free is prevented by using one or more pairs of free-spinning rollers to compress the tubing at a location along its path from supply roll to garment, at least some of which rollers are fitted with unidirectional clutches to prevent reverse rotation. It is not necessary to have any non-slip coatings on the rollers if both rollers of each pair compressing the tubing wall between them are fitted with unidirectional clutches. This is feasible, even where one of the pair of rollers is less accessible by being within the tubing, because the unidirectional clutches are compact and may be mounted within each roller.

Static electric charge is preferably removed from the surface of the tubing contacted by one of the pair of rollers, by providing that roller with an electrically grounded electrically conductive surface. The main structure of the apparatus is connected to a good electrical ground, such as a cold water pipe, and the more accessible roller is itself all-metal and conductive by metal-to-metal electrical contact through a metal bearing to the structure of the apparatus which has been grounded. The less accessible roller of the pair need not be grounded, and need not have an electrically conductive surface. Thus, it may be made of plastic, or may be covered with non-slip rubber. If the less accessible roller has a unidirectional clutch and is covered with non-slip rubber, then it is not necessary to have a unidirectional clutch fitted to the more accessible and uncoated grounded roller of the pin.

The apparatus of the present application employs only one combined clamp for cutting and sealing, and this clamp is mounted on a moveable frame which is swung up out of the way when the clamp is not being used for cutting or sealing. The elements provided on the clamp for cutting and sealing are normally cold. At the outset, when the operator places the hanger mounted garment on the support, the combined clamp is out of the way and has no hot parts. Thus, the placing of the mounted garment in position on the apparatus is convenient and safe. When the proper time arrives, the frame with the combined clamp is swung down into position. The clamp closes, the cutting element is heated by a short, controlled pulse to cut, the sealing elements are electrically pulsed to heat and thus seal, and the clamp opens. The cutting and sealing elements quickly cool. The completed bagged garment may then be taken away, after which the machine automatically resets to starting position.

DETAILED DESCRIPTION OF THE PREFERRED EMBODIMENT

Figure 1:
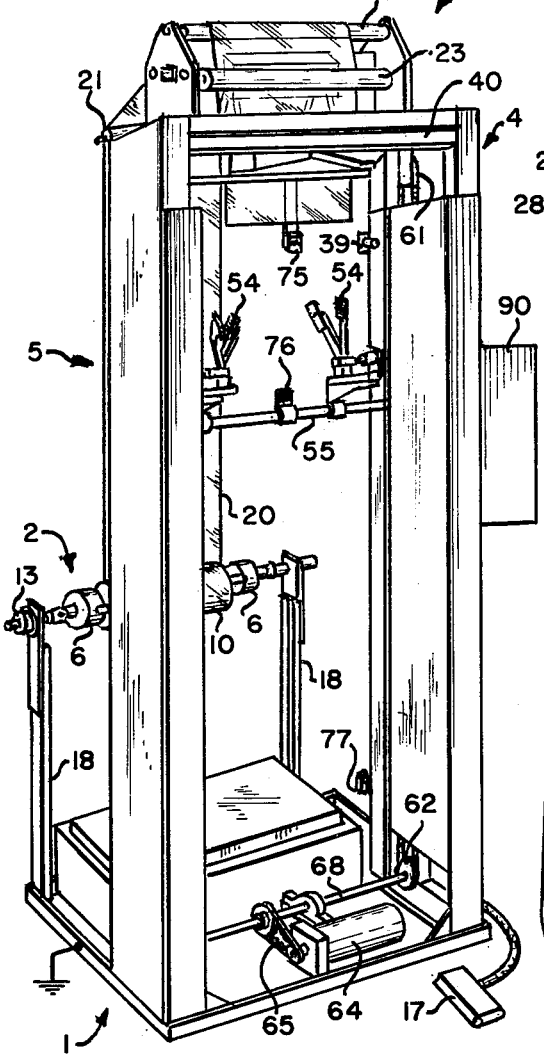
FIG. 1 is a perspective view of the apparatus for forming bags about hanger mounted garments.
Figure 2:
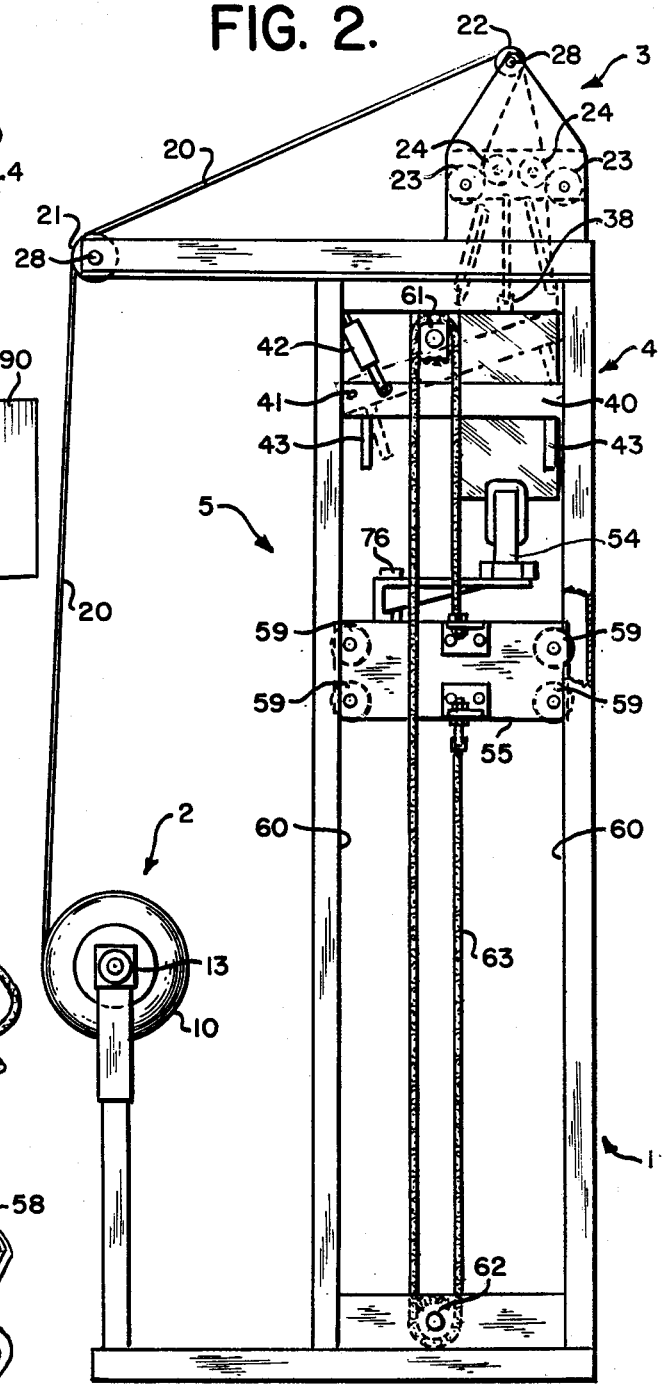
FIG. 2 is a side elevation view of the bag forming apparatus.
Figure 7:
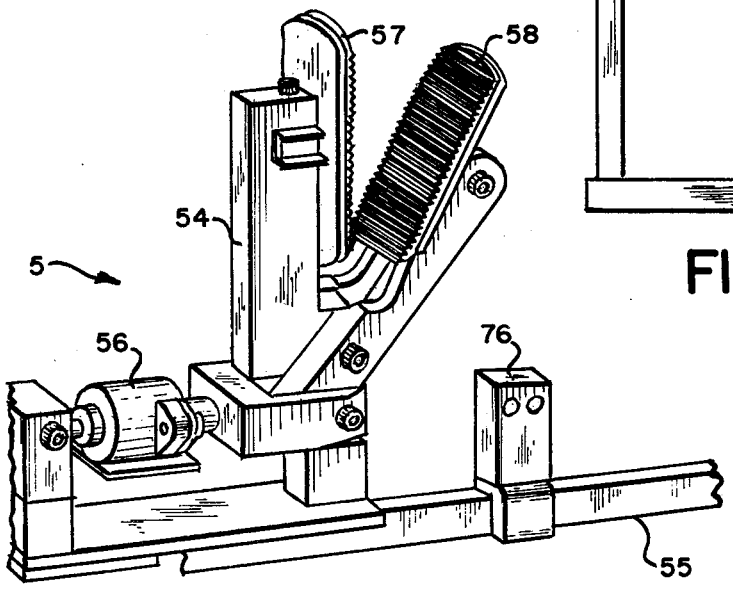
FIG. 7 is a detail perspective view of one of the pneumatic gripping clamps for engaging the end of the tubular wrapping material in order to pull it over a garment.

Referring now to the drawings in detail and particularly to FIGS. 1 and 2, the apparatus for forming bags about hanger mounted garments is generally designated by the reference numeral 1. This apparatus includes in the lower rear a holder, also shown in FIG. 6, which is generally designated by the numeral 2. The holder 2 carries a supply roll 10 of continuous flattened tubular web 20 of heat sealable wrapping material such as, for example, polyethylene. The flattened tubing 20 is led in a path up and forward over rollers 21 and 22 to a cradle and cradle support assembly, generally designated by reference numeral 3, at the top of the apparatus 1. Cradle and cradle support assembly 3 may also be seen in FIGS. 3, 4 and 8. Included in apparatus 1, further along the path of tubing 20 downstream of and just below assembly 3, is a heat seal and cutting assembly generally designated by the reference numeral 4. Apparatus 1 also includes a gripping carriage device generally designated by the reference numeral 5.

Figure 6:
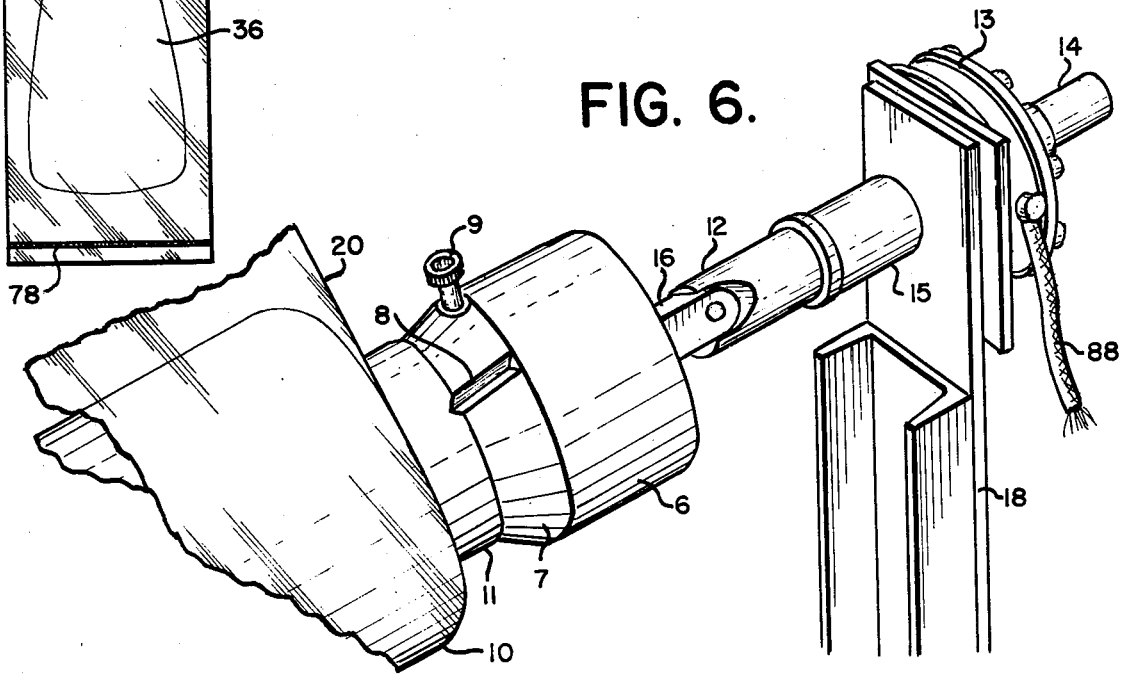
FIG. 6 is a detail perspective view of one side of the supply roll holder showing the flywheel and brake.

FIG. 6 shows one end of the holder 2. A vertical bracket 18 mounts a conventional bearing 15 and an electrically activated brake 13, which in the preferred embodiment is a Warner brake model No. 3425. An electrical control cable 88 extends from the brake 13 to a control box 90 on the right side of apparatus 1. A shaft part 14 extends through the brake 13 and bearing 15 and is joined to a shaft part 16 by a universal joint 12. A metal flywheel 6 is mounted on the shaft part 16 and locked by a set screw 9. Flywheel 6 has a conical end 7 which is jammed into the open end of a hollow cardboard tube 11, which serves as the central support for the roll 10 of flattened tubular web 20. Several sharp-edged raised keys 8 are spaced around the conical end 7, which cut into carboard tube 11 to prevent rotational slippage. As shown in FIG. 1, the other end of holder device 2 is generally the same as the end just described and shown in FIG. 6, excepting that preferably there is no brake 13, a brake on one end being sufficient. Of course, if desired, a second brake operating in unison with the one brake 13 could be included.

Figure 8:
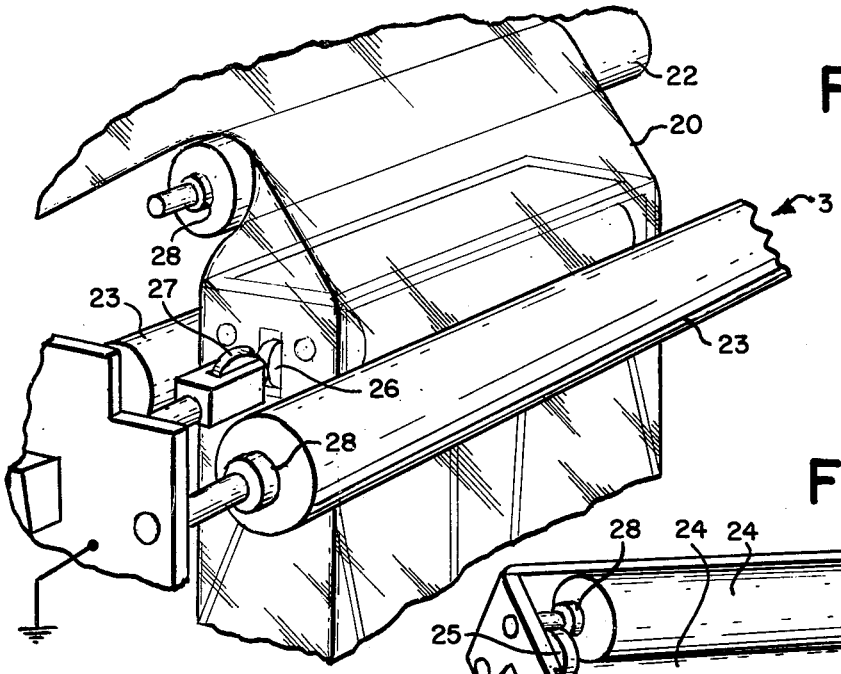
FIG. 8 is a perspective view of the top of the apparatus showing the cradle within the tubing resting on the support rollers.

As shown in FIGS. 1 and 2, the flattened tubing 20 passes up from the supply roll 10 and over a free-spinning roller 21 mounted at the top rear of apparatus 1, then forward and over a free-spinning roller 22 mounted above the cradle and cradle support assembly 3, and then down (see also FIG. 8). The cradle support assembly includes two support rollers 23 fixed to apparatus 1 in parallel and spaced apart relation in a horizontal place. Support rollers 23 are also free-spinning, and are preferably made of metal with uncoated metal surfaces and with both rollers electrically connected to a good electrical ground, such as a cold water pipe. It has been found that an adequate electrical connection is made from the metal roller through an all-metal bearing to the metal structure of the apparatus which is grounded. If desired, a spring metal wiper may be used for direct connection from the grounded apparatus structure to one end of the roller surface, a method well known to those skilled in the art. In this way the rollers 23 present electrically conductive, electrically grounded surfaces.

A cradle, generally designated by the reference numeral 30 (see FIG. 9) contains two parallel, free-spinning rollers 24. In the preferred embodiment rollers 24 are made from PVC tubing. They may instead be made of metal, or metal covered by a frictional material such as rubber. Rollers 24 are mounted within cradle body 34 spaced apart so that the maximum width measured from the outermost element of one roller 24 to the outermost element of the other roller 24 is somewhat greater than the spacing between the innermost elements of rollers 23 (see FIGS. 2 and 8). Thus, when cradle 30 is placed onto support rollers 23 with the plane of cradle rollers 24 horizontal, rollers 24 as mounted within the cradle body 34 will not pass between rollers 23 as mounted on the apparatus 1 but, instead, will be supported thereby. The flattened tubular web 20 is opened and passed down from roller 22 to enclose and pass around cradle 30 while passing between rollers 23 downwards. Thus, rollers 24 on the cradle each now compresses one wall of the tubular web of tube 20 against the corresponding or opposed one of support rollers 23. If the tube 20 is pulled forward, all of rollers 21, 22, 23 and 24 rotate.

Figure 9:
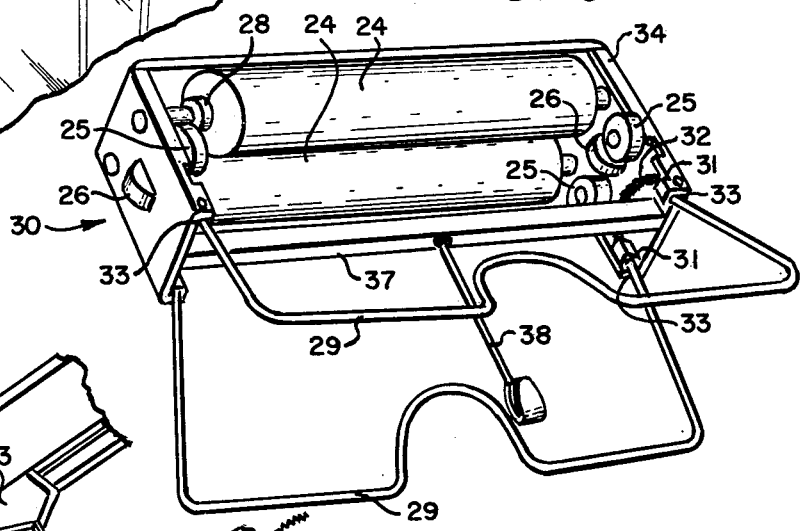
FIG. 9 is a perspective view of the cradle with support hook and barn door spreaders attached.

As may be seen in FIG. 9, four guide wheels 25, which are free-spinning, are mounted on the corners of the cradle body 34 below rollers 24 so that when the plane of rollers 24 is horizontal and rollers 24 rest compressing the web of tube 20 against corresponding support rollers 23, the guide wheels 25 will lie with their rotational axes in substantially the same plane as the horizontal plane of support rollers 23, and guide wheels 25 will just fit within the closest approach spacing of support rollers 23, so that each wheel 25 compresses a wall of web 20 lightly against a support roller 23. In this way, the cradle 30 is kept substantially vertical and supported upon support rollers 23. In similar fashion, two wheels 26, also free-spinning, are mounted on the ends of cradle body 34 in the same plane as the wheels 25, and two free-spinning wheels 27 are mounted on apparatus 1 between and in the plane of support rollers 23, so that each wheel 26 presses lightly through the web of enclosing tube 20 against one of wheels 27 to restrain any end-to-end movement of cradle 30.

At least one, and preferably all, of rollers 22, 23 and 24 are fitted with internal one way clutches 28 mounted in such a direction that only forward motion of tubing 20 is accommodated, and pull-back of tubing 20 towards supply roll 10 is prevented. In the preferred embodiment, Torrington RC 101410 clutches and Torrington IR 6121 inner races are used on ⅜ inch shafts for rollers 22 and 24, while support rollers 23 are fitted with Torrington RC 121610 clutches and Torrington IR 812 inner races on ½ inch shafts.

A bar 37 is mounted parallel to and below rollers 24 across the middle of the bottom of cradle body 34, from which bar a support 38 depends centrally, to receive a hook 35 of a hanger on which is mounted a garment 36 to be bagged.

A pair of outwardly directed "barn door" wire members 29 are pivotally mounted on cradle body 34 by hinges 31 near the four bottom corners of the cradle so as to swing out fore and aft within the tubing 20 which passes over and around the cradle 30. These members 29 also extend inwardly beyond hinges 31 within the cradle body 34. Tension springs 32 bias together the pair of inward extensions of members 29 within each end of cradle body 34, thereby urging "barn door" members 29 to swing open. Stops 33 are provided at the four bottom corners of cradle body 34 to limit the outward swing of the members 29 to a predetermined excursion. When necessary to accommodate a closing of the opened tube 20 downstream from the cradle 30, such as during cut and seal operations to be discussed later, the "barn door" members 29 can swing in together against the bias provided by springs 32. After tube 20 has been cut, there may be places along the upstream cut edge where the two sides of the tubular web 20 tend to stick together. The biasing which urges the "barn door" members 29 to swing open causes them to spread open the two sides of cut tubular web 20 away from one another. In this way, tubular web 20 is kept open and ready to be pulled down over a hanger-mounted garment 36.

Below cradle 30, the heat seal and cutting assembly 4 is mounted on a moveable frame 40 which is hinged by pivot pins 41 at the back of apparatus 1, so that the assembly 4 can move between a horizontal operating position below support 38 and an elevated storage position at approximately the level of support 38. In FIG. 2, assembly 4 is shown in solid lines in the operating position, and in dashed lines in the storage position. FIG. 1 shows assembly 4 in the storage position, while FIGS. 3, 4, 10 and 11 show assembly 4 in the operating position. When a hanger mounted garment 36 is in position to be bagged, with hanger hook 35 on support 38, assembly 4 in operating position is above garment 36 but below support 38. An actuator 42 is provided to effect the movement of assembly 4 between the storage and the operating position. Any appropriate conventional actuator may be used, from the wide selection of hydraulic, pneumatic, and electric solenoid actuators which is commercially available and known to those skilled in the automatic bagging machine art. In the preferred embodiment, pneumatic actuators are used wherever actuators are called for, including actuator 42.

Figure 4:
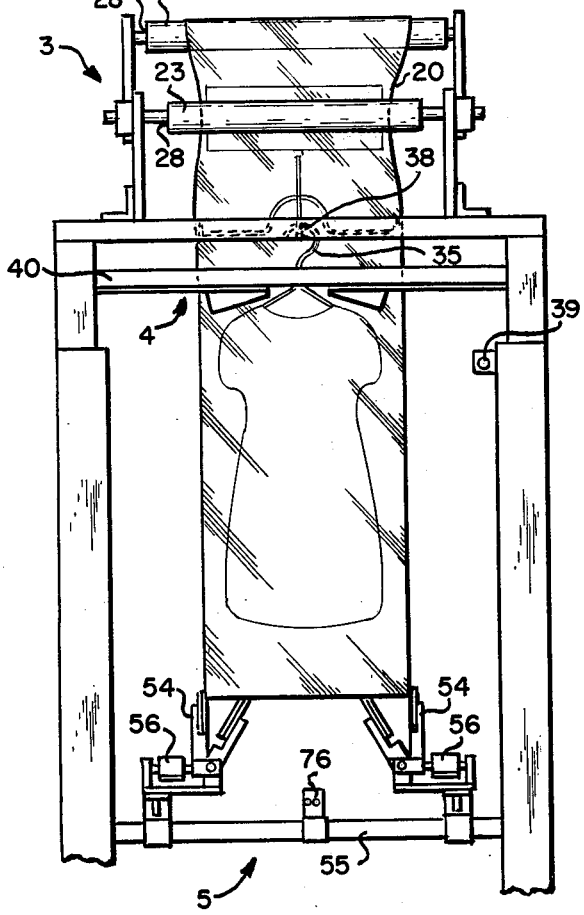
FIG. 4 is a view similar to FIG. 3 but showing the upper portion of the apparatus near the end of the bag forming cycle after the tubing length has been cut free and the gripping clamps have been released, but before the top seal has been formed.
Figure 5:
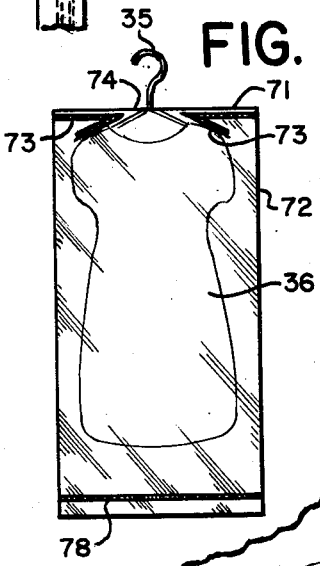
FIG. 5 is a front elevational view of a completed bag in place about a hanger mounted garment.

The transverse cut which is made in order to free tube length 72 from the continuous tubular web 20 is along a single straight line 71 (see FIG. 5). As may also be seen in FIG. 4, the cut crosses hanger hook 35. In contrast, the heat seal closure is made in two portions 73, each in the shape of a reverse hook path, running in from the outside parallel to and below cut line 71, then reversing to slope downwards above and parallel to the top of garment 36 as it runs back to the outside, leaving an unsealed gap 74 between the two portions through which the hanger hook 35 extends.

The heat and cutting assembly 4 includes a pair of jaws 43 fore and aft of the tubing 20 as it passes or extends down from cradle 30. The jaws 43 are relieved in the center to permit hanger hook 35 to extend up to hook support 38. Electrical heating wires are mounted on the opposing faces of these jaws for cutting and sealing tubing 20 (see FIGS. 10 and 11). As will already be understood, the cut wires 45 are upstream of the seal wires 44 and run transversely completely across from left to right in straight and continuous lines. Two are provided, fore and aft at the same level, to ensure a continuous and complete severance of tube length 72 including fore and aft of hanger hook 35, which is crossed by cut line 71. The seal wires 44 in the preferred embodiment are only provided on the aft jaw face, on seal wire on the left and one on the right, to effect the left and right portions of closure 73, leaving the unsealed gap 74 for passage of the hanger hook 35. Preferably, they are on opposed reverse hook paths as described before, providing a double line closure above garment 36 on either side, left and right.

Over the faces of jaws 43, and between the jaw faces and the cut and seal wires, are mounted face covers 46, formed as from sheet to bend back over the bounding edges of the jaws where they are secured by strips 47. In the preferred embodiment, face covers 46 are made from unfilled Teflon sheet, but any suitable material could be used which is heat resistant, thermally and electrically insulating, and non-adhering to melted heat sealable material.

The cut and seal wires may be made from any of the many commercially available electric heating wire materials well known to those skilled in the art of heat sealing and cutting webbing of heat seal material, commonly nickel-chromium alloys or nickel-chromium-iron alloys. They may be held at the ends by screws or clamps, or preferably may be pre-formed with loops at each end which may be set over nail-headed pins. Spring devices 48 are provided at at least one end of every wire to maintain the wires taut as they expand when heated and contract when allowed to cool.

Figure 10:
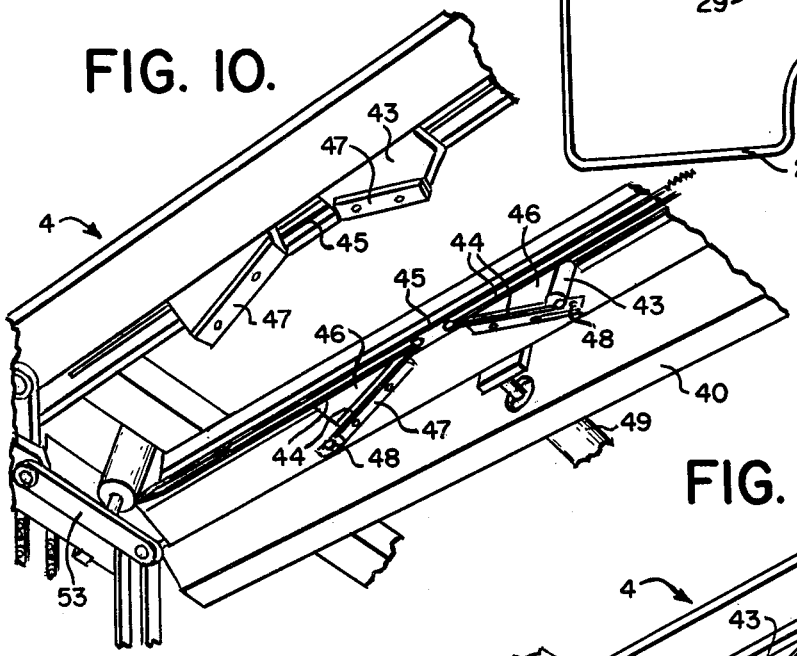
FIG. 10 is a perspective view of the cut and seal assembly with the frame in operating position and the clamping jaws open.
Figure 11:
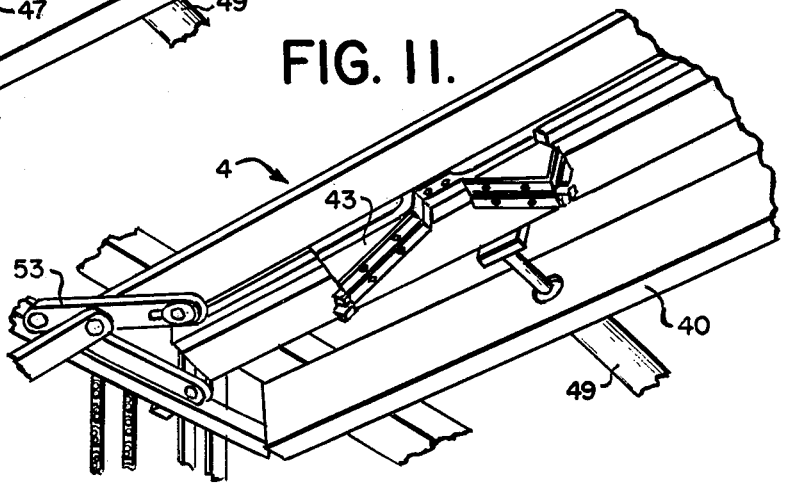
FIG. 11 is a perspective view of the cut and seal assembly with the frame in operating position and the clamping jaws closed.

The pair of jaws 43 are mounted on the frame 40 so that each is moveable inwardly to a closed position, and outwardly to an open position, shown respectively in FIGS. 11 and 10. Substantially identical but mirror-image bar linkages 53 are provided at the left and right ends of the frame 40 to couple the motions of the jaws 43, so that when the aft jaw moves forward the forward jaw moves backward, and vice versa. A pneumatic actuator 49 is provided to effect movement forward and backward of the aft jaw, which by the coupling action of the bar linkages 53 effects corresponding mirror-image movement of the forward jaw. Other standard actuators could also be used, as discussed previously in connection with frame actuator 42. Alternately, if desired, bar linkages 53 could be omitted and a second actuator corresponding to actuator 49 could be provided to effect the movement of the forward jaw.

The actuator 49 and bar linkages 53 also coact to maintain the closed cut and seal position with one jaw face pressing towards the other jaw face. During the cut and seal operations the tube 20 is clamped and held under pressure between the jaws 43.

Figure 13:
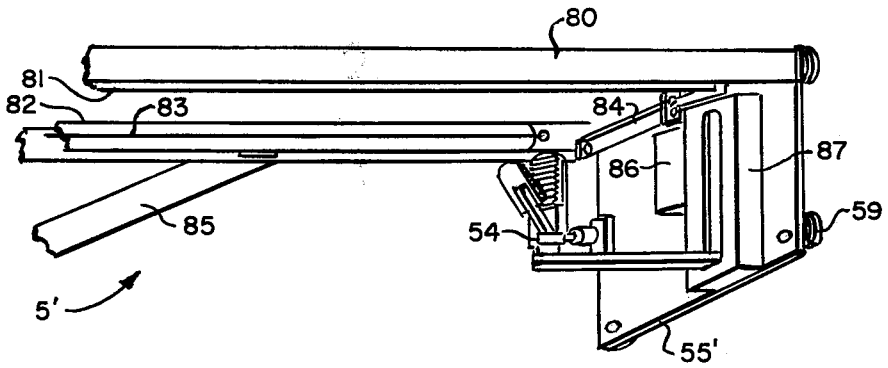
FIG. 13 is a detailed perspective view of a modified carriage having an optional lower seal assembly.

For those machines in which a bottom seal capability is desired, the gripping carriage device 5 may be modified to the structure 5' shown in FIG. 13, in which a bottom seal assembly 80 is mounted on carriage 55'. This assembly carries a pair of jaws 81 and 82, on one of which is mounted a seal wire 83. The structure is substantially as discussed above for the heat seal and cutting assembly, excepting that the frame is not hinged as was frame 40. The fore and aft jaws move as described above, by means of bar linkages 84 and an actuator 85.

If a bottom sealer is included, each grip 54 is mounted for vertical motion with respect to carriage 55', which motion is effected by a motor 86 driving a recirculating ball screw linear traverse mechanism 87. There are many standard devices commercially available which may be used for this function, well known to those skilled in the art, for example pneumatic actuators or linear electric motors. At the start of a bagging sequence, the two grips 54 are at their upper position, extending upwards beyond assembly 80 so as to be in position to reach and sieze the open end of tubing 20. While carriage 55' moves down pulling a length of tubing 20 over the grament 36, motor 86 is activated to lower grips 54 to the position shown in FIG. 13 below assembly 80. Thus, at the time it is desired to make bottom seal 78, grips 54 are out of the way.

Figure 3:
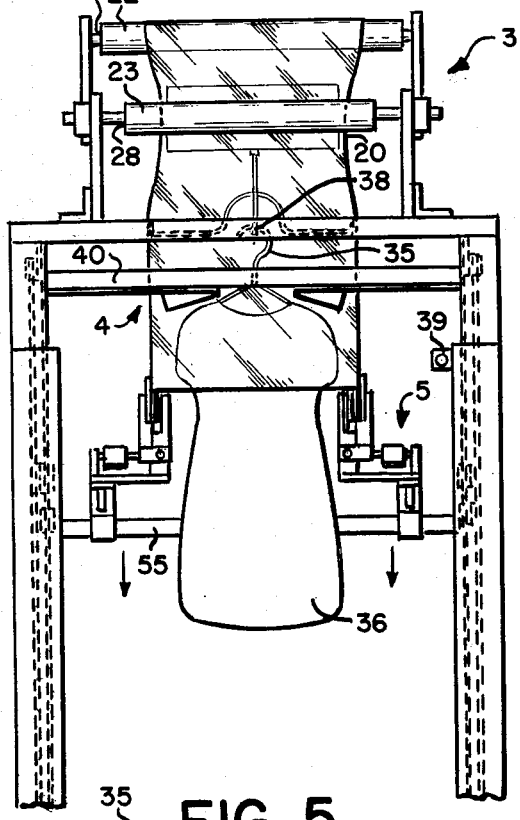
FIG. 3 is a fragmentary front elevational view showing the upper portion of the apparatus midway during the step of pulling the tubular web of wrapping material over a hanger mounted garment.

In the preferred embodiment without a bottom seal capability, the gripping carriage device 5 is provided to pull tubing 20 over hanger mounted garment 36. See FIGS. 1–4 and 7. Two grips 54 are mounted, left and right, on the upper side of a carriage 55, which carriage can be moved to an extreme upstream position just down from the operating position of the heat seal and cutting assembly 4. At this upstream position, the grips 54 extend up through frame 40 of assembly 4 to locations at the left and right of the "barn door" spreader members 29, which are within tubing 20 pressing the fore and aft sides of tubing 20 apart and open upstream of the cut. Still at this upstream position, when the grips 54 are open, an inner side 58 of each grip is within open tubing 20, and its mating outer side 57 is without open tubing 20. An actuator 56, preferably pneumatic, is provided for each grip 54, to effect opening and closing of the grips. FIG. 3 shows the grips closed to engage the open tubing 20 for pulling, and FIG. 4 shows the grips open to release the tubing 20 after a length 72 has been pulled.

Four vertical rails 60 are mounted within the bagging apparatus to guide carriage 55 along a traverse from said upstream position downwards and back again. Two grooved wheels 59 are mounted at each corner of carriage 55 to run on one of the four rails 60.

The vertical traversing movement of carriage 55 is effected by a motor which drives a pair of sprocket chains 63, one attached to each side of carriage 55, left and right. Each chain 63 is looped over an idler sprocket gear 61 mounted at the top of apparatus 1 and driven sprocket gear 62 mounted at the bottom, one side of chain loop 63 being attached to carriage 55. Rotation of driven gear 62 causes chain loop 63 to move, idler gear 61 to rotate, and carriage 55 to traverse vertically.

Figure 12:
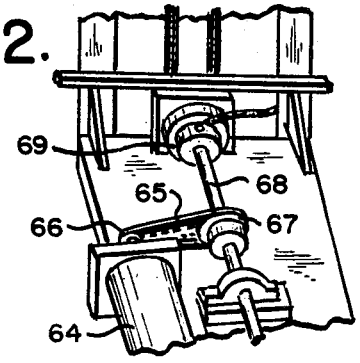
FIG. 12 is a detailed perspective view of the motor drive and lower transmission parts for effecting traverse of the carriage.

The two driven sprocket gears 62 are fixed at opposite ends, left and right, of a shaft 68 mounted in bearings across the bottom of apparatus 1 (FIGS. 1, 2 and 12). An electric brake 69 is mounted within the bottom of apparatus 1 to act on shaft 68. An Ogura Model No. MNB1.2 is used in the preferred embodiment. This brake is activated only when the apparatus is turned off. An electrically reversible motor 64 is mounted within the bottom of apparatus 1 alongside shaft 68, cogged sheaves or pulleys 66 and 67 are provided, respectively, on the motor and on shaft 68, and a cogged rubber belt 65 is fitted over and between these cogged pulleys, so that motor 64 drives shaft 68.

In the preferred embodiment, precise motion control of carriage 55 is made possible by use of a stepping motor for motor 64, for example a Sigma Model No. 21-4270 D 200-F03, which rotates one step of nine-tenths of a degree each time it receives a voltage pulse, thus rotating one full turn of 400 such steps upon the motor receiving a sequence of 400 such pulses. These individual small steps are smoothed out and absorbed by including in the motor drive the cogged rubber belt 65, also known as a timing belt, which provides the known elasticity and damping characteristics of rubber belts with a desired non-slip characteristic provided by the cogs or teeth. Thus, the motor drive provides continuous motion to shaft 68. Shaft 68 drives sprocket gears 62 fixed at its ends, which move chain loops 63 attached to each side of carriage 55, all serving as a transmission operated by the motor drive so as to effect vertical traversing movement of carriage 55.

When a new length 72 of flattened tubular web 20 is to be pulled from supply roll 10 and over a hanger-mounted garment 36, carriage 55 is in its upstream position and grips 54 are closed to engage the open end of tubing 20. Carriage 55 is then traversed downward by motor drive 64, 66, 65 and 67, and transmission shaft 68, gears 62 and chains 63. As already noted, all tube handling along the path of tubing 20 from the supply roll 10 to the open end is free wheeling. Further, brake 13 on the supply roll holder is inoperative during pulling. Thus, the force required to pull the tube will be for the most part only the force necessary to overcome the inertia of supply roll 10 and its attached flywheels 6, the force which causes roll 10 and flywheels 6 to start to turn by rotational acceleration. Since the supply roll 10 is partially consumed during the formation of each bag, and so is diminished as bag lengths 72 are repeatedly pulled off, consideration must be given to how this diminishing radius and corresponding mass of supply roll 10 will affect the pulling force.

One layer of tubing 20 circumferential around roll 10 represents a shorter length if the radius is smaller, than the length that would pay out in one revolution when the roll was new and first started at a larger radius. Similarly, a smaller radius roll has to rotate faster than a large one, to supply a given linear velocity of tubing 20 as dictated by the movement of carriage 55. Finally, for a given linear acceleration of the carriage 55 and so of the tubing 20, the corresponding rotational acceleration of roll 10 grows larger as the radius diminishes.

The torque to accomplish a given rotational acceleration is the product of pulling force times the radius of roll 10. Therefore, to achieve a given torque, pulling force must be increased as roll 10 radius diminishes.

These last two factors combine to make that portion of the pulling force which rotationally accelerates the fixed flywheels 6 grow larger with diminishing radius in proportion to the inverse or reciprocal square of the radius.

The rotational inertia of roll 10 itself, however, is directly proportional to the fourth power of the radius. Applying the inverse square factor just found above to this direct fourth power, we find that the portion of the pulling force which rotationally accelerates the roll 10 itself will grow smaller with diminishing radius in proportion to the direct square of the radius. Thus, one portion of the pulling force grows larger, while the other portion grows smaller, so it is possible by proper selection of the size of the flywheels 6 to substantially offset one change with the other and have a total pulling force which remains more or less the same whether the supply roll is relatively large, or used up and small. One skilled in the art of designing and building automatic baggers can easily try a few sizes of flywheels 6 in order to arrive at a size in relation to the size range of roll 10 over which he desires to provide the optimum offset.

In the preferred embodiment, each of the two flywheels has a rotational inertia of 0.06 lb.-in.-sec.$^2$. This value particularly improves the operation of the apparatus towards the end of a roll, levelling out the otherwise rapid change of pulling force during that period of the diminishment of the roll. Moreover, this is not such a large flywheel inertia value as to excessively add to the pulling force at the time a new roll is started, such as might cause the tubing to tear. The invention embraces flywheels chosen in order to locate the optimum offset in any range of roll diminishment, selected for any period between installation of a new roll and exhaustion of the last of the tubing on a roll.

The pulling force is substantially proportional to the linear acceleration of carriage 55, when grips 54 on the carriage 55 seize tubing 20 and pull a length of tubing. This linear acceleration may be controlled at as large a value as the strength of tubing 20 will permit, so that the bagger may operate quickly yet without stretching or tearing tubing 20.

The preferred motion of carriage 55 in any one pulling begins at a set minimum speed, increases speed at constant linear acceleration to a second or maximum speed, continues at this second speed until a trigger point just short of the point at which a desired length 72 of tubing 20 will have been pulled over garment 36, and then decreases speed at a constant deceleration to a full stop, at which point the length 72 will have been pulled.

This carriage motion is provided by supplying voltage pulses to the stepping motor at a frequency such that the averaged rotation of the stepping motor 64 as smoothed by belt 65 into a continuous rotation received by the transmission at shaft 68, gives a desired speed to carriage 55. Thus, in a pulling, these pulses begin at a set minimum frequency, increase in frequency at a constant pulse acceleration to a second maximum frequency, continue at this second frequency until a trigger point just short of the point at which a desired length 72 of tubing 20 will have been pulled over garment 36, and then decrease frequency at a constant pulse deceleration to zero frequency, corresponding to a full stop.

The control for the stepping motor drive circuit, which applies these voltage pulses to the stepping motor, is based on a ramp generator which supplies a voltage signal which varies with time in proportion to the desired speed of carriage 55. This voltage signal is fed to a voltage-to-frequency converter, which drives a decoding logic, which in turn causes the stepping motor drive circuit to supply the desired frequency of voltage pulses to the stepping motor. This voltage signal begins with a set minimum voltage corresponding to the set minimum speed of carriage 55. The voltage then increases linearly with time to a second voltage, holds constant, and then decreases linearly with time to zero, corresponding to a full stop of carriage 55.

Sensors at the top and bottom detect when carriage 55 has moved to either extreme position. For instance, a Micro Model No. FYCD 16 E 1-2 magnetic sensor 39 is used in the preferred embodiment to indicate when carriage 55 passes to the top, starting position, while overtravel downwards is indicated by an emergency stop switch 77, a Micro Model No. BZE6-2RQ2. Alternately, either detector could be used at top or bottom, or other position detectors could be substituted from among those commercially available and known to those skilled in the bagger apparatus art.

The garment is sensed by two detectors, preferably two photodetectors 75 and 76. The upper detector 75 is fixed on the apparatus below and behind support 38 to sense the presence of a garment 36 in place ready for bagging, while the lower detector 76 is mounted on carriage 55 to detect when the carriage has moved past the bottom of the garment 36 when pulling tube over the garment. In the preferred embodiment, detectors 75 and 76 are each a Warner Model No. MC 5626. These emit a light of predetermined wavelength and time variation, and sense only light having those identical characteristics which may be reflected back by a garment. Sonic devices, or other commercially available detection devices, well known to those skilled in the bagger art, may be employed in lieu of the photodetectors.

Figure 16A:
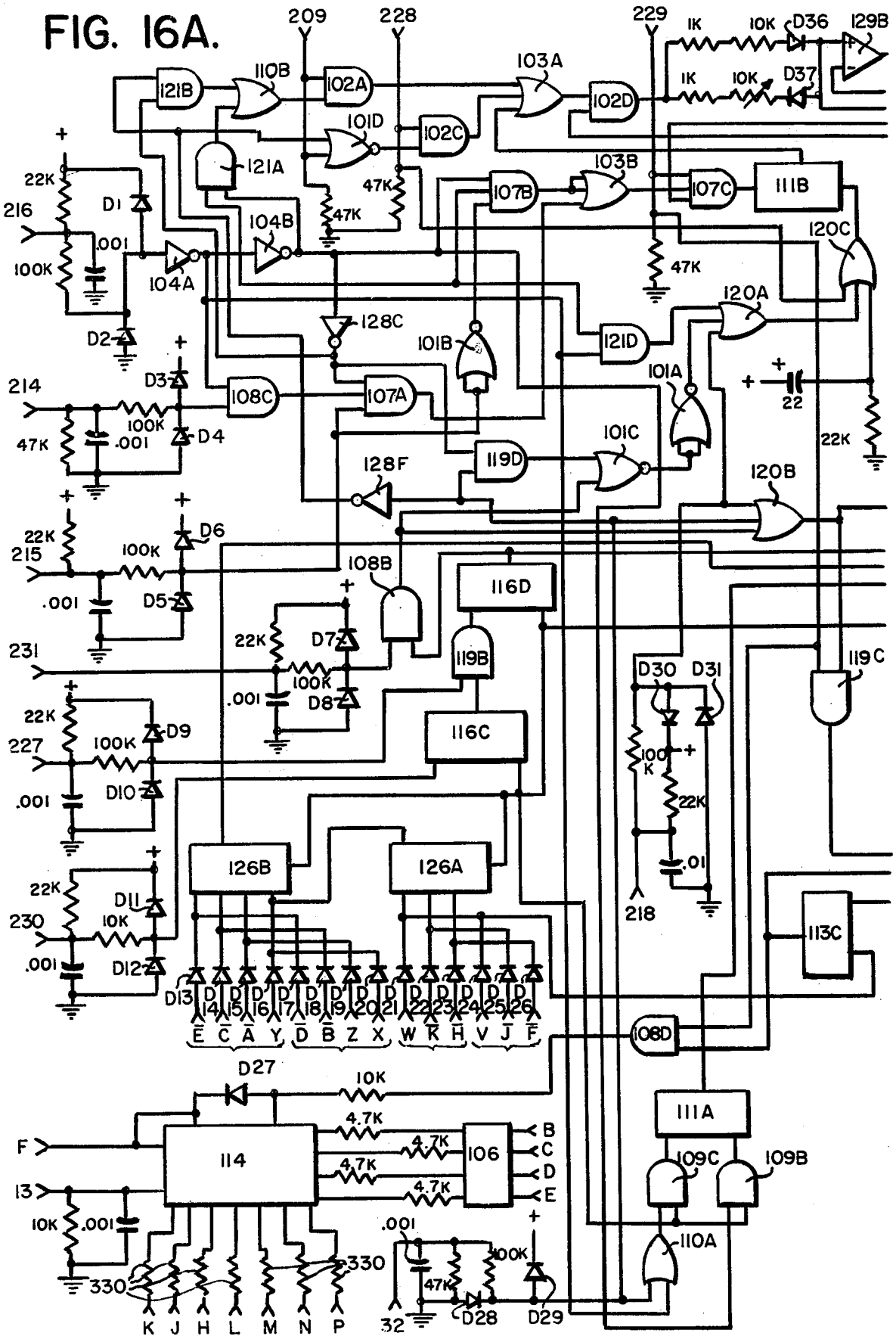
FIGS. 16A, 16B and 16C, when placed side-by-side with 16A on the left, as shown in FIG. 16D, together make up a schematic diagram of the bagger apparatus control circuit
Figure 16B:
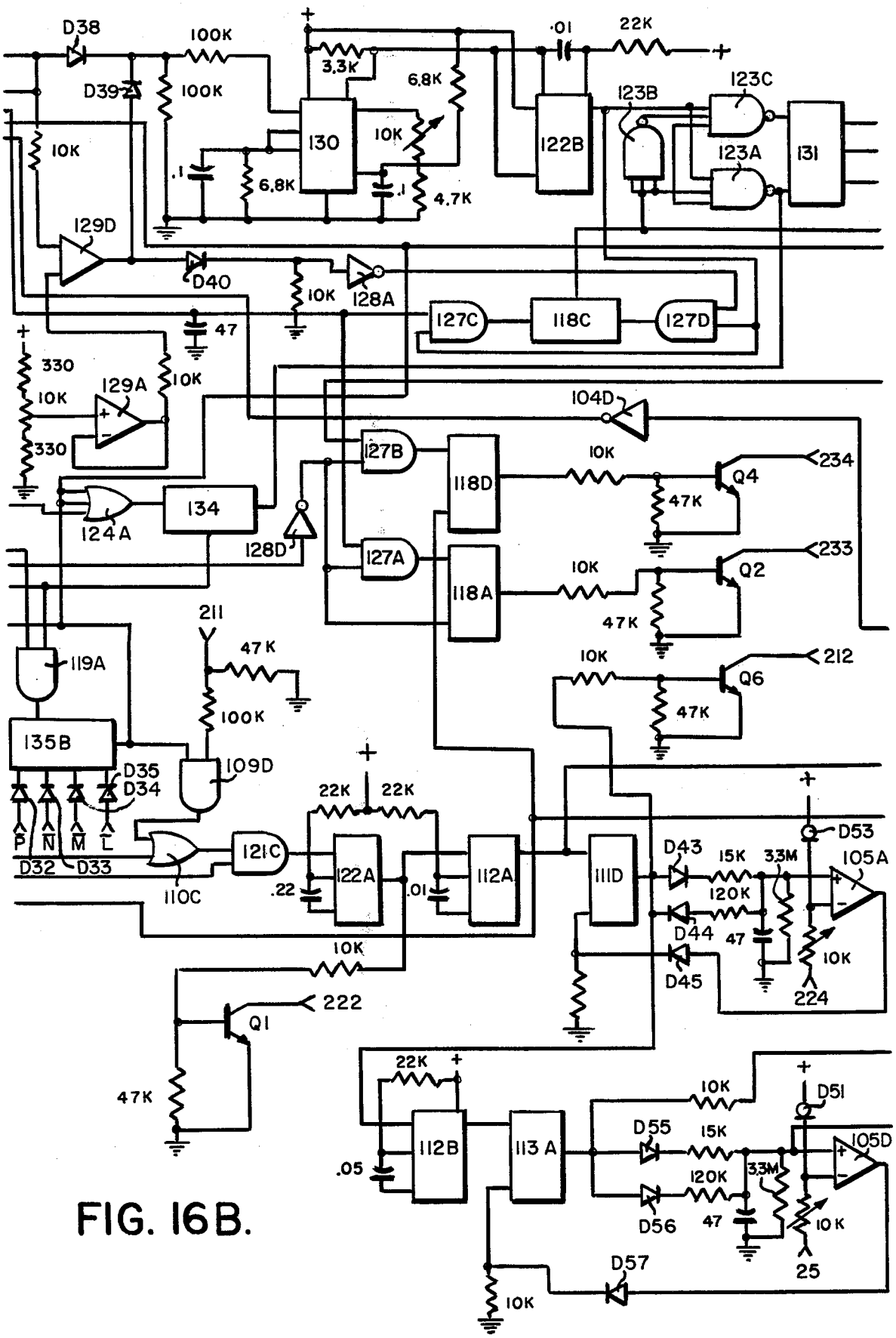
Figures 16C, 16D:
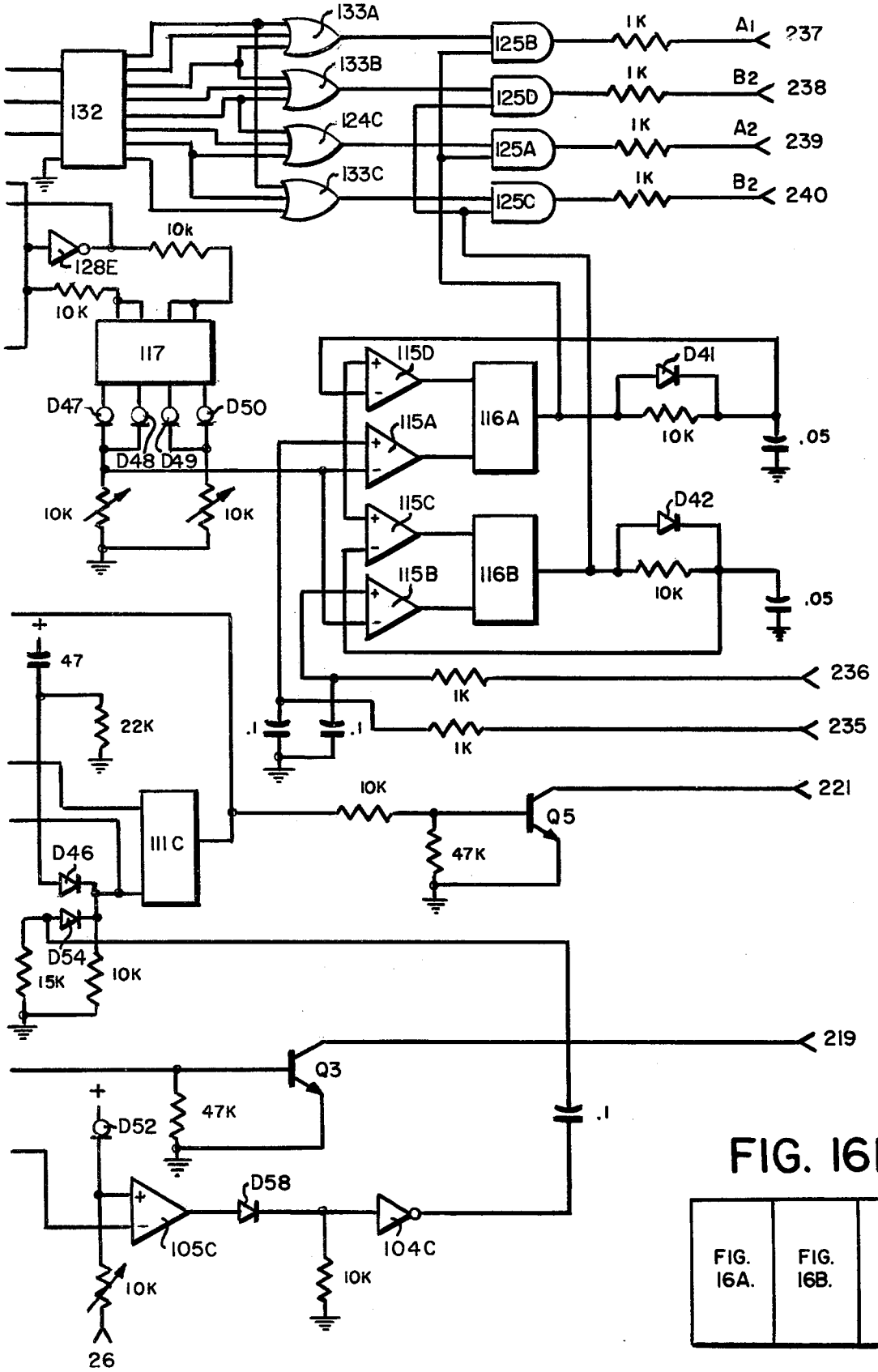

The sequential functions of the apparatus are controlled by digital electronic circuitry located in the control box 90 shown in FIG. 1. Any suitable control circuitry will suffice for the purposes of the present invention. One such control circuit is shown in FIGS. 16A, 16B and 16C, hereinafter FIGS. 16A-C. The entire circuit may be viewed by placing the three drawings side by side and in sequence from left to right as shown in FIG. 16D. In FIGS. 16A-C logic gates 101 through 134, including following letters, represent standard, commonly available circuits. These circuits are typically packaged in integrated circuit form with one or more logic gates contained in each integrated circuit. Logic gates appearing in FIGS. 16A-C which have the same number followed by a different letter suffix (i.e. 121A and 121B) represent similar logic gates which are simply located in the same integrated circuit for the purposes of the presently described embodiment. Commonly available integrated circuits which may be used to construct the control circuit shown in FIGS. 16A-C are as follows:

| Circuit No. | Integrated circuit identification |
|---|---|
| 101 | 4001 |
| 102, 108, 109, 119, 121, 125, 127 | 4081 |
| 103, 120, 124, 133 | 4075 |
| 104, 128 | 40106 |
| 105, 115, 129 | Texas Instruments TL084 |
| 106, 117 | RCA CA3083 |
| 107 | 4073 |
| 110 | 4071 |
| 111, 113, 116, 118 | 4043 |
| 112, 122 | 4528 |
| 114 | National Semiconductor 74C925 |
| 123 | 4023 |
| 126 and 135 | 4518 |
| 130 | Raytheon RC 4151 |
| 131 | 40193 |
| 132 | 4028 |

-continued

| Circuit No. | Integrated circuit identification |
|---|---|
| 134 | 4040 |

Plain identification numbers appearing in the above list refer to J.E.D.E.C. industrial standard numbers.

In FIGS. 16A–C, all resistors are designated by their resistance valve which is in ohms and all capacitors are designated by their capacitance value which is in microfarads. Transistors Q1 through Q6 are all Texas Instrument's TIP 112. Diodes D1 through D46 are all IN4148, while diodes D47 through D53 are all Siliconix constant current diodes, D47 and D49 being CR110, D48 and D50 being CR200, and D51 through D54 being CR042.

The control circuit of FIGS. 17A–C is connected to the previously described apparatus in the following manner. The upper photodetector 75 is connected to the input terminal 215. The foot switch 17 is connected to input terminal 214. The upper magnetic sensor 39 is connected to input terminal 216. The lower photodetector 76 is connected to terminal 227. The emergency stop switch 77 is connected to terminal 232. A thumbwheel switch (not shown) is connected to outputs of counter 126A and 126B and to terminal 230. A second thumbwheel switch (not shown) is also connected to outputs of the counter 126A and 126B and to terminal 218. A third thumbwheel switch (not shown) is connected to outputs of counter 135 and to terminal 231. A typical thumbwheel switch which may be used for the first and second counters indicated above is available from C & K Components, Inc. of Watertown, Mass. and is model no. 322110000. A typical thumbwheel switch which may be used for the third counter indicated above is model number 312110000 available from the same manufacturer. A mode select switch (not shown) is connected to terminals 209 and 229 to determine either a manual or automatic mode of operation. A switch (not shown) is connected to terminal 228 for providing a manual jog in the manual mode of operation. A solenoid operated air valve controlling the pneumatic activator for the cut and seal frame 42 is connected to terminal 234. A solenoid controlling the pneumatic activator for the grips 54 is connected to terminal 233. One such solenoid operated air valve which may be used for both of the above is a Humphrey Model 125-E1-3-10-21-35 three-way valve. A relay controlling the voltage to cut elements 45 is connected to terminal 212.

The supply roll brake 13 is connected to terminal 222. A relay controlling energization of the seal wires 44 is connected to terminal 219. One such relay which may be used for energizing both the cut wires 45 and the seal wires 44 is a Croydom Model D1240 solid state relay. A solenoid operated air valve controlling the pneumatic activator for the top seal clamp drive 49 is connected to terminal 221. One such valve is a Humphrey Model 125-4E1-20-35 four-way valve. A switch (not shown) is connected to terminal 211 for providing a manual cut signal thereto. Terminals 235 and 236 are connected to the current sense output terminals 335 and 336 shown in FIG. 15. Terminals 237 through 240 carry the signals controlling motor speed and direction and are connected to terminals 337 through 340, respectively, shown in FIG. 15. All of the internal connections in FIGS. 16A–C are intended to be disclosed by the drawing. Anyone of ordinary skill in the art of digital electronics can easily construct the circuit of FIGS. 16A–C given the normally accepted meanings for the logic symbols used and the integrated circuit identifications appearing above. This circuit and its operation are further described below in relation to the functional operation of the apparatus.

Figure 15:
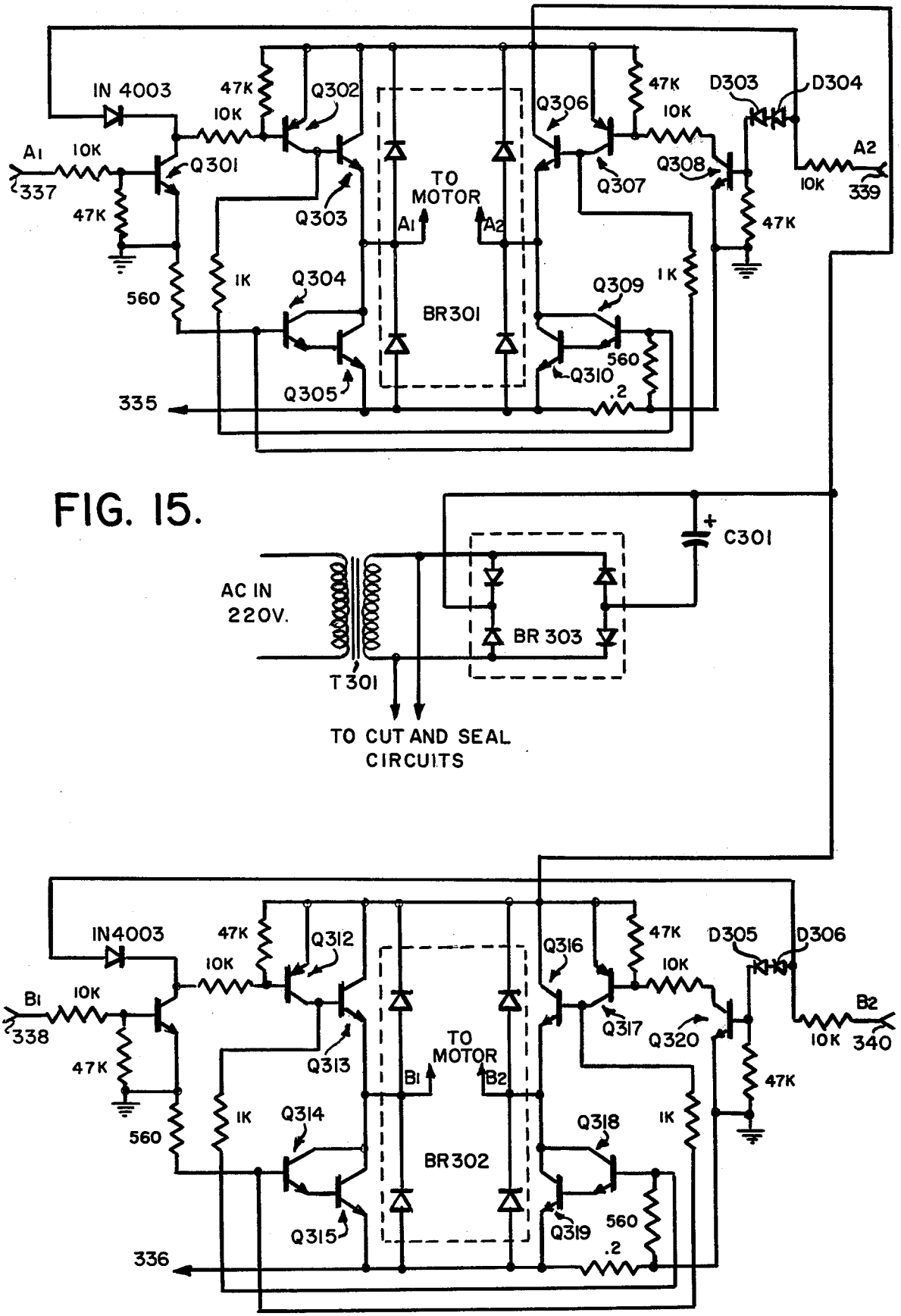
FIG. 15 is a schematic diagram of the stepper motor circuit drive.

FIG. 15 shows the stepper motor drive circuit, which connects to the circuit of FIGS. 16A–C at terminals 335–340 as previously described. Diodes D303, 304, 305 and 306 are 1N 4148. Transistors Q303, 305, 306, 310, 313, 315, 316 and 319 are 2N6259. Transistors Q302, 307, 312 and 317 are TIP127, Q304, 309, 314 and 318 are TIP 33C, Q301, 308, 311 and 320 are TIP 112, all from Texas Instruments. BR301, 302 and 303 are part number S6324-2 from Sarkes Tarzian. Capacitor C301 is a FALM 1400-100-C6 of CDE. Transformer T30l is a Signal 68-25. Again, resistors are identified by their resistance value in ohms and capacitors are identified by their capacitance in microfarads.

The stepper motor drive is a bipolar chopper drive. A motor winding is connected by a four transistor bridge to a voltage supply and the current is sensed in the common side of the bridge. The bridge is turned on until the current reaches a rated value, and then turned off. During the off interval, the current is circulated to the power supply through diodes. The bridge is turned back on when the current has dropped to a preset low limit. Two identical circuits drive the motor 64. Just as stated before with reference to the bagger control board circuit, this stepper motor drive is the presently preferred circuit, presented by way of illustration. One skilled in the art can readily select standard circuits to accomplish the functions described.

Figure 14:
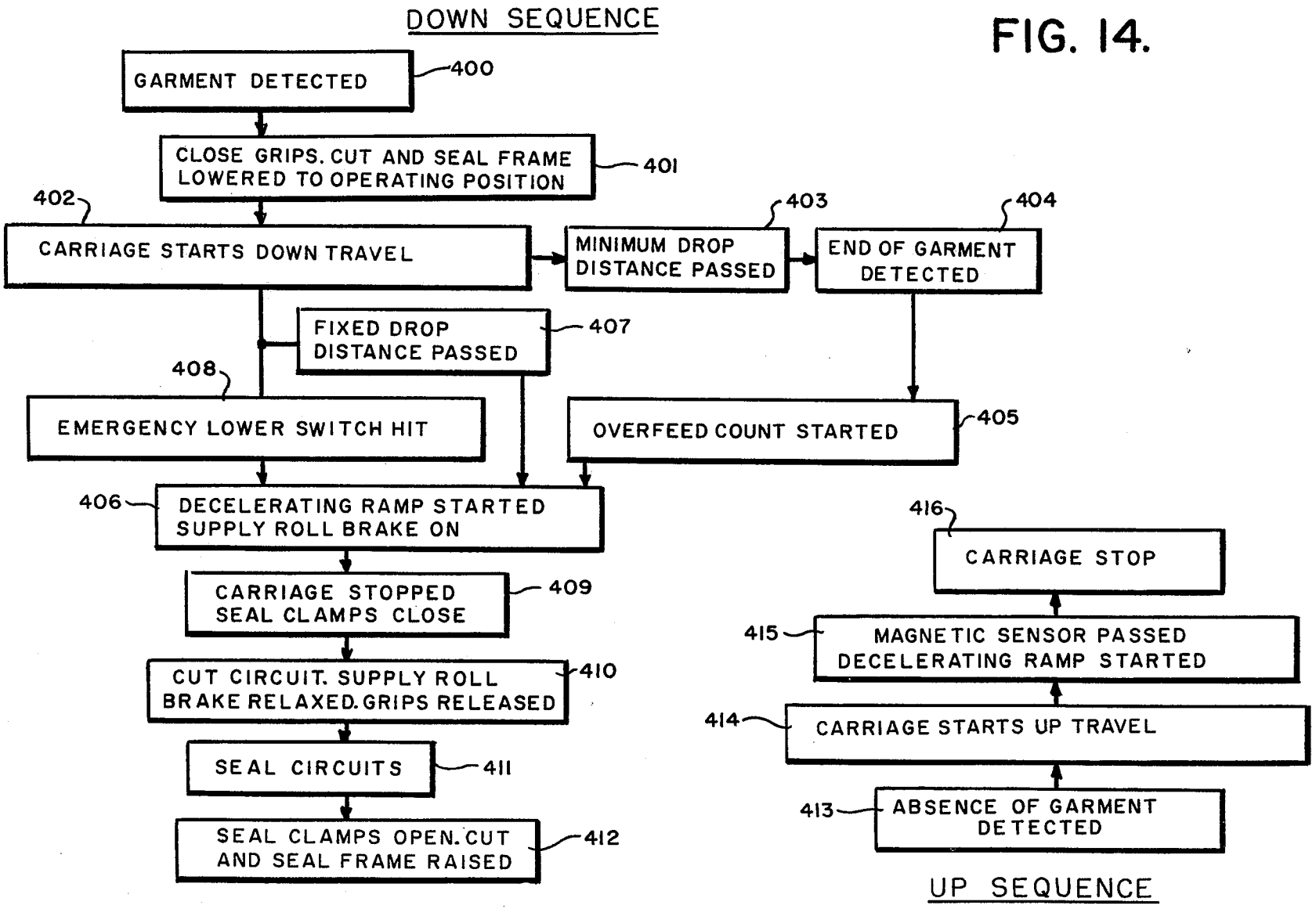
FIG. 14 is a block diagram of the operating sequence of the apparatus.

The operation of the apparatus described above will now be explained in reference to the control circuit shown in FIG. 16A–C and the block diagram of the functional operating sequence shown in FIG. 14.

When the apparatus is in the automatic operating mode, a garment is first placed on the hook support 38 and the foot switch 17 is depressed. The garment is detected by the upper photodetector 75, as indicated by function box 400. The foot switch 17 and photodetector 75 signals are inputed to the control circuit at terminals 214 and 215 respectively. In response to the detection of a garment and activation of the foot switch 17 the grips 54 are activated by the flip-flop 118A and the cut and seal frame 42 is lowered to the operative position, shown in FIG. 2, by the flip-flop 118D, according to the functional block 40l. The upper magnetic sensor 39 detects the upper position of the carriage 55 and the circuit logic causes the operational amplifier 129B to generate a voltage which is connected to the voltage-to-frequency converter 130. The pulse signal generated by the converter 130 is connected through coding logic to the motor drive circuit of FIG. 15 and causes the carriage 55 to move downward according to the functional block 402. The voltage generated by the operational amplifier 129B starts at a minimum value and gradually increases in ramp form to a maximum value to change the velocity of the form carriage 55 by a constant acceleration between the low initial speed and the higher running speed. The pulse signal from the converter 130 is passed through a divider 134 to a counter formed by circuits 126A and 126B. The output of the counter of 126A and 126B is fed to terminals $\overline{E}$, $\overline{C}$, $\overline{A'}$ $\overline{N}$, $\overline{W}$, $\overline{K}$ and $\overline{H}$ and also to terminals $\overline{D}$, $\overline{B}$, Z, X, V, $\overline{J}$ and $\overline{F}$. A thumbwheel switch (not shown) is connected to one of the above sets of terminals.

When the carriage 55 reaches a minimum length point, the counter of 126A and 126B reaches a "minimum length" number as set on the thumbwheel switch and the thumbwheel switch generates a signal connected to terminal 230, which signal sets flip-flop 116C. The setting of flip-flop 116C enables a signal from the lower photodetector 76 to set flip-flop 116D via AND gate 119B according to function block 404. The setting of flip-flop 116C also enables AND gates 108B and 119A. The pulses from the counter 134 are therefore passed through AND gate 119A to operate the overfeed counter 135B. The output of the overfeed counter 135B is available at terminals $\overline{P}$, $\overline{N}$, $\overline{M}$ and $\overline{L}$ and is thereby connected to a second thumbwheel switch. When the counter of 135B reaches the overfeed count set into the second thumbwheel switch that thumbwheel switch generates a signal connected to the overtravel input terminal 231. This signal goes on to reset flip-flop 111B to start the generation of a deceleration ramp according to function block 406.

A third thumbwheel switch (not shown) is connected to the other set of terminals carrying the output of the counter of 126A and 126B. If the counter of 126A and 126B reaches a count representing a fixed length as set into the third thumbwheel switch before a signal is generated by the photodetector 76, the third thumbwheel switch will generate a signal connected to terminal 218, which signal will cause the resetting of flip-flop 111B and the beginning of the deceleration ramp. Thus, the function of block 407 would be performed.

The generation of a deceleration ramp, which is performed by the operational amplifier 129B, can also be triggered by a signal from switch 77, according to function block 408. With the generation of a deceleration ramp a monostable multivibrator 122A is triggered and activates the supply roll brake 13 via the terminal 222 for a predetermined amount of time still in accordance with function block 406. The signal from the vibrator 122A in turn triggers another monostable multivibrator 112A, which after another predetermined delay sets flip-flops 111D and 111C. The setting of flip-flop 111C causes the seal clamps or jaws 43 carrying the cut and seal wires 45 and 44 to close around the top of the bag, in accordance with function block 409. On setting of the flip-flop 111D, power is connected to the cut wires 45. After a predetermined amount of time the bag is cut by the wires 45 and power thereto is shut off. The amount of time during which power is connected to the cut wires 45 is determined by the amount of time that the 47 μf capacitor connected to the (+) input of operational amplifier 105A takes to charge to the voltage value connected to the negative (−) input of operational amplifier 105A. The voltage at the negative (−) terminal can be varied according to the resistance connected between that terminal and ground through terminal 224. Since heavy tubing 20, such as 1 mil. polyethylene, requires more heat to be cut than does light tubing, such as ½ or ¾ mil. thickness, adjustment is provided to vary the heat generated by the wire 45 by so varying the resistance between the (−) terminal of amplifier 105A and ground.

When the voltages at the (+) and (−) inputs of amplifier 105A are equal the output becomes positive and causes the flip-flop 111D to reset. Thus, the amount of time that the cut wires 45 are energized is varied in response to the thickness of the bag material by changing the value of the resistance between the negative input of amplifier 105A and ground. The bag is thereby cut in accordance with function block 410. The resetting of flip-flop 111D triggers a monostable multivibrator 112B which sets flip-flop 113A. The setting of flip-flop 113A applies power to the seal wires 44. Power is applied to the seal wires by an operational amplifier 105D for a predetermined amount of time. This amount of time is controlled by the voltage inputs to amplifier 105D in the same manner as that described for amplifier 105A and similarly in response to the thickness of the bag material. Thus, the bag is sealed according to function block 411.

When the predetermined amount of time passes and amplifier 105D resets flip-flop 113A, the voltage at the positive (+) input of that amplifier begins to decay by the discharge of the 47 μf capacitor through the 120K resistor. This discharge rate is set at the cooling rate of the seal wires 44. Thus, if any residual heat remains in the wires 44, this is reflected in the charge across the 47 μf capacitor and less time is needed for a subsequent sealing operation. The voltage at the (+) input of amplifier 105D is also connected to the (−) input of operational amplifier 105C. When this voltage decays to the voltage at the (+) input of amplifier 105C the flip-flop 111C is reset causing release of the cut and seal jaws 3. The cut and seal frame flip-flop 118D is also reset and the assembly 42 is raised to the inoperative position. A resetting of flip-flop 111C also pulses counter 114 through AND gate 108D to register one more bagged garment on that counter. Thus, function block 412 is performed.

When the bagged garment is removed from the hook support 38 according to function block 413, a signal from the upper photodetector 75 causes the operational amplifier 129B to generate a gradually increasing voltage ramp which is converted by the voltage-to-frequency converter 130 into a pulse wave with a gradually increasing frequency. The pulse wave is used by the coding logic 131 to drive the motor 64 in the reverse direction, thus moving the carriage 55 in the upward direction in accordance with function block 414. And finally, when the magnetic sensor 39 detects the carriage 55 a signal is generated to initiate the deceleration ramp of the amplifier 129B in accordance with function block 415 and carriage 55 is eventually stopped in accordance with function block 416. Thus, the apparatus is reset for the detection of the next garment.

It will be understood that various modifications and alternate configurations may be made in the preferred embodiments shown and described herein without departure from the scope of the invention as defined by the appended claims.

What is claimed is:

1. In an apparatus for repeatedly forming garment bags, each bag formed about a garment on a hanger with a hook, each bag formed from a length of tubular heat sealable material pulled and cut free from a supply roll of said material, said apparatus being the type which includes a support for holding said hanger mounted garment in position for bagging, a supply roll holder which permits rotation of said roll, a pulling means including a motor drive for advancing said tubular material by pulling said tube length from said roll along a path of movement and over said garment, a cutting means for transversely cutting free said tube length, and heat seal means for effecting a transverse closure of said tube length with said support extending through said closure, the improvement comprising:

(a) an anti pull-back means proximate said support on the side thereof towards said supply roll holder for preventing pull-back of said tubular heat sealable material after each said length thereof has been cut free;

(b) brake means for restraining rotation of said supply roll when said roll is within said holder;

(c) means for deactivating said brake means when said pulling means is activated;

(d) means for controlling said pulling means to limit the linear acceleration of said tubular material during pulling; and (e) a flywheel connected to said supply roll for rotation therewith when said roll is within said holder, whereby as said supply roll is diminished by each pull of a tube length, the portion of the pulling force necessary to rotationally accelerate said diminished supply roll is decreased but, since the required angular acceleration of said diminished supply roll is increased, the regular acceleration of said fixed inertia flywheel is likewise increased to substantially correspondingly require an increase in another portion of said pulling force to maintain said total pulling force substantially constant.

2. An apparatus in accordance with claim 1, wherein said anti pull-back means comprises:

(a) a first free-spinning roller mounted on said apparatus in a position alongside and cross-wise of said tubing path of movement when said tubing is in said apparatus;

(b) a second free-spinning roller disposed adjacent and parallel to said first roller so that said tubular web will pass between said first and second rollers;

(c) means biasing said second roller towards said first roller for compressing said tubular web when disposed between said rollers; and (d) a unidirectional clutch attached to said second roller permitting rotation of said second roller only in the direction accomodating the advancing of said tubular material.

3. An apparatus in accordance with claim 2, wherein said first roller has an electrically conductive surface which is electrically grounded for removing static electricity from the surface it contacts of the tube material when disposed in compression between said roller and said adjacent roller.

4. An apparatus in accordance with claim 1, wherein said cutting means is located upstream of the position for said hanger mounted garment and downstream from said anti pull-back means, further comprising a spreader means disposable within a tube along said path of movement for opening said tubing to encircle said garment, said spreader being disposed in said apparatus upstream of said cutting means and downstream from said anti pull-back means, whereby when said tube length is cut free the tubing upstream of said cut will be spread open to encircle another garment on the next successive operation of the machine.

5. An apparatus in accordance with claim 4, wherein said support is centered downstream of said spreader means, and in which said pulling means further includes:

(a) a carriage;

(b) a traverse means mounting said carriage on the downstream side of said spreader means for reciprocal movement downstream away from and upstream towards said spreader means;

(c) a transmission means operatively connecting said motor drive to said carriage to effect said reciprocal movement wherein there is a fixed relationship between acceleration of said motor drive and linear acceleration of said carriage driven thereby; and (d) gripping means attached to said carriage on the upstream side thereof for releasably engaging said open tubing when said tubing is in said apparatus.

6. An apparatus in accordance with claim 5, wherein said motor drive included in said pulling means comprises: a rotary stepping motor responsive to electronic pulses; a first cogged pulley operatively mounted on said motor for stepped rotation thereby; a second cogged pulley operatively mounted on said transmission means to effect rotation thereof; and a cogged rubber belt operatively mounted to connect said first cogged pulley to said second cogged pulley so that stepped rotation of said stepping motor results in continuous rotation of said transmission means; said control means further comprising an electronic pulse generating circuit preset to supply said motor at each pulling with a series of pulses at a pulse rate increasing at a predetermined pulse acceleration rate to a maximum pulse frequency so that said motor drive responds to each pulling with a corresponding predetermined motor drive acceleration, whereby said tube is pulled from said roll at said related predetermined linear tube acceleration.

7. An apparatus in accordance with claim 1, further comprising a moveable frame, said cutting means and said heat seal means being mounted close together on said frame, guide means mounting said frame on said apparatus for movement between an operating location proximate said support upstream of the position for said hanger mounted garment and a storage location distant said hook support, and first actuator means for effecting said movement of said frame between said locations, said cutting means further being mounted upstream of said sealing means when said frame is in said operating location.

8. An apparatus in accordance with claim 1, in which said cutting means comprises an electrically conductive wire; said heat seal means comprises another electrically conductive wire; and further comprising a biasing means for holding each said wire taut; a pair of jaws having flat faces; a pair of face covers made of material which is heat resistant, thermally and electrically insulating, and non-adhering to melted heat sealable material; clamping means for movement of said jaws between an open position with said jaws apart and facing one another, and a closed cut and seal position with one jaw face pressing towards the other jaw face; second actuator means for effecting said movement of said jaws between said positions and for maintaining said closed cut and seal position; first mounting means for attaching each of said pair of face covers to the flat face of one of said pair of jaws; second mounting means for attaching each said wire with each said biasing means upon one of said face covers; first electronic circuit means for supplying on command to said cut wire a cutting current pulse of time duration of predetermined relation to the elapsed time since the previous cutting pulse and to the thickness and type of heat sealable material; and second electronic circuit means for supplying on command to said seal wire a sealing current pulse of time duration of predetermined relation to the elapsed time since the previous sealing pulse and to the thickness and type of heat sealable material.

9. An apparatus in accordance with claim 8, further comprising a third electronic circuit means for causing said second actuator means to maintain said cut and seal position for a time duration after said sealing current pulse of predetermined relation to the elapsed time since the previous sealing pulse, and to the thickness and type of heat sealable material.

10. An apparatus in accordance with claim 1, further comprising a first detection means for sensing said hanger-mounted garment in position for bagging, initiation means for automatically starting the operation of the apparatus when said garment is thereby sensed to be in position, and reset means for automatically returning the apparatus to starting configuration when said garment is thereby sensed to have been removed after said bag has been formed thereabout.

11. An apparatus in accordance with claim 1, further comprising a second detection means for sensing when said tube length has been pulled completely over said garment, and stop means for stopping said pulling by said pulling means at a predetermined additional distance beyond said garment after said second detection means has so sensed.

12. An apparatus in accordance with claim 1, further comprising a means for counting the number of bags that have been formed about said hanger mounted garments.

13. An apparatus in accordance with claim 1, further comprising a supplementary heat seal means for effecting a transverse closure of said tube length downstream from and adjacent said garment.

* * * * *